US010648313B2

(12) United States Patent
Aguilera et al.

(10) Patent No.: US 10,648,313 B2
(45) Date of Patent: May 12, 2020

(54) LOW PRESSURE FLUID INJECTION FOR RECOVERING HYDROCARBON MATERIAL FROM LOW PERMEABILITY FORMATIONS

(71) Applicant: NEXEN ENERGY ULC, Calgary (CA)

(72) Inventors: Roberto Aguilera, Calgary (CA); Karthik Selvan, Calgary (CA)

(73) Assignee: CNOOC PETROLEUM NORTH AMERICA ULC, Calgary (CA)

( * ) Notice: Subject to any disclaimer, the term of this patent is extended or adjusted under 35 U.S.C. 154(b) by 0 days.

(21) Appl. No.: 15/978,343

(22) Filed: May 14, 2018

(65) Prior Publication Data

US 2018/0328158 A1 Nov. 15, 2018

Related U.S. Application Data

(60) Provisional application No. 62/505,575, filed on May 12, 2017.

(51) Int. Cl.
*E21B 43/16* (2006.01)
*E21B 43/26* (2006.01)
*E21B 43/267* (2006.01)

(52) U.S. Cl.
CPC ..... *E21B 43/267* (2013.01); *E21B 43/162* (2013.01); *E21B 43/261* (2013.01)

(58) Field of Classification Search
CPC ..... E21B 43/162; E21B 43/261; E21B 43/267
See application file for complete search history.

(56) References Cited

U.S. PATENT DOCUMENTS 4,156,464 A * 5/1979 Hussin ..... E21B 43/267 166/307
6,047,773 A * 4/2000 Zeltmann ..... E21B 21/14 166/281
7,681,635 B2 * 3/2010 Farabee ..... E21B 43/114 166/177.5
8,757,259 B2 * 6/2014 Lesko ..... C09K 8/665 166/280.1
9,850,422 B2 * 12/2017 Lestz ..... C09K 8/64
9,909,404 B2 * 3/2018 Hwang ..... C09K 8/80
2018/0187538 A1 * 7/2018 Walters ..... E21B 43/267

* cited by examiner

*Primary Examiner* — Matthew R Buck
(74) *Attorney, Agent, or Firm* — Norton Rose Fulbright Canada LLP

(57) ABSTRACT

A process for producing hydrocarbon material from a subterranean formation comprising:

injecting a first conditioning material, via a wellbore, to effect fracturing of a subterranean formation such that a hydraulically fractured formation, including an induced fracture, is obtained;

after the fracturing, injecting post-fracturing conditioning material, via the wellbore, into hydraulically fractured formation; and after the injecting of the post-fracturing conditioning material, producing, via the wellbore, hydrocarbon material from the hydraulically fractured formation;

wherein:

the pressure of the post-fracturing conditioning material is less than the pressure of the injected fracturing fluid; and the post-fracturing conditioning material includes proppant.

6 Claims, 2 Drawing Sheets

LOW PRESSURE FLUID INJECTION FOR RECOVERING HYDROCARBON MATERIAL FROM LOW PERMEABILITY FORMATIONS

FIELD

The present disclosure relates to recovery of hydrocarbon material from low permeability formations.

BACKGROUND

In order to produce hydrocarbons from within a subterranean formation, a wellbore is drilled, penetrating the subterranean formation. This provides a partial flow path for hydrocarbon, received by the wellbore, to be conducted to the surface. In order to be received by the wellbore at a sufficiently desirable rate, there must exist a sufficiently unimpeded flow path from the hydrocarbon-bearing formation to the wellbore through which the hydrocarbon may be conducted to the wellbore.

In some cases, in order to establish the flow path for conducting the hydrocarbon to the wellbore, it is necessary to create new fractures or extend existing fractures within the subterranean formation. Such fractures are more permeable to the flow of hydrocarbons than the formation.

To initiate new fractures, hydraulic fracturing fluid is injected through wellbore into the subterranean formation at sufficient rates and pressures for the purpose of hydrocarbon production. The fracturing fluid injection rate exceeds the filtration rate into the formation producing increasing hydraulic pressure at the sand face. When the pressure exceeds a critical value (the fracture initiation pressure), the formation rock cracks and fractures.

The induced fractures are often interconnected with existing naturally occurring fractures. Often, the permeability of such naturally occurring fractures is relatively low.

BRIEF DESCRIPTION OF DRAWINGS

In the drawings, embodiments are illustrated by way of example. It is to be expressly understood that the description and drawings are only for the purpose of illustration and as an aid to understanding, and are not intended as a definition of the limits of the invention.

Embodiments will now be described, by way of example only, with reference to the attached figures, wherein.

DETAILED DESCRIPTION

Figure 1:
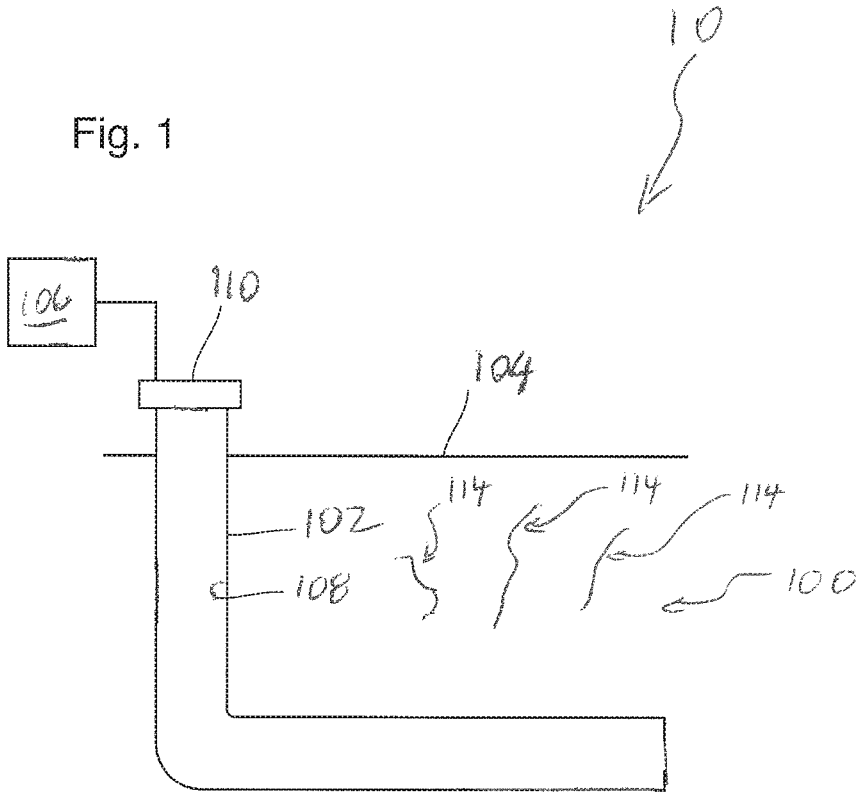
FIG. 1 is a schematic illustration of a system for facilitating production of hydrocarbon material from a subterranean formation subterranean formation that includes a wellbore extending through the subterranean formation.
Figure 2:
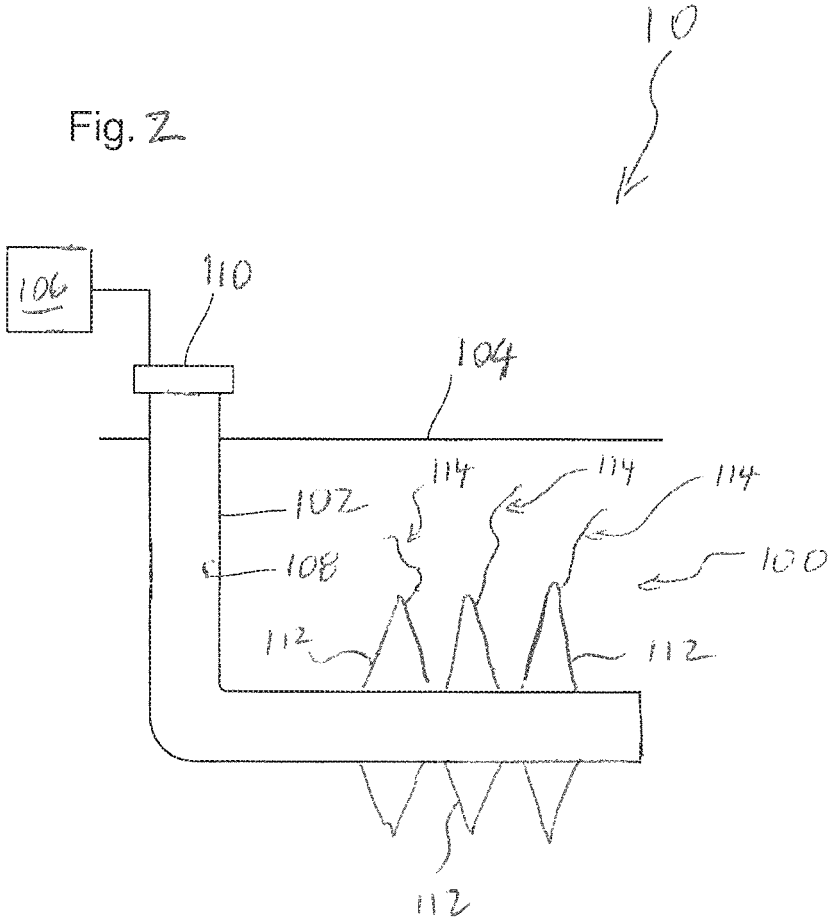
FIG. 2 is a schematic illustration of the system in FIG. 1, after hydraulic fracturing has been effected.

Referring to FIG. 1, there is provided a system 10, with associated apparatuses, for producing hydrocarbon material from a reservoir within a subterranean formation 100. The hydrocarbon material can be liquid, gaseous, or can include both of liquid hydrocarbon material and gaseous hydrocarbon material The subterranean formation 100 may be onshore or offshore. In some embodiments, for example, the subterranean formation 100 is a formation that is characterized by a relatively low permeability, such as for example, a permeability of less than 1.0 millidarcies, such as, for example, less than 0.1 millidarcies. In some embodiments, for example, the subterranean formation includes shale.

The producing of the hydrocarbon material is effected by a wellbore 102 that penetrates a surface 104 of, and extends into, the subterranean formation 100.

As used herein, the terms "up", "upward", "upper", or "uphole", mean, relativistically, in closer proximity to the surface 104 and further away from the bottom of the wellbore, when measured along the longitudinal axis of the wellbore 102. The terms "down", "downward", "lower", or "downhole" mean, relativistically, further away from the surface 104 and in closer proximity to the bottom of the wellbore 102, when measured along the longitudinal axis of the wellbore 102.

The wellbore 102 can be straight, curved, or branched. The wellbore 102 can have various wellbore portions. A wellbore portion is an axial length of a wellbore 102. A wellbore portion can be characterized as "vertical" or "horizontal" even though the actual axial orientation can vary from true vertical or true horizontal, and even though the axial path can tend to "corkscrew" or otherwise vary. The term "horizontal", when used to describe a wellbore portion, refers to a horizontal or highly deviated wellbore portion as understood in the art, such as, for example, a wellbore portion having a longitudinal axis that is between 70 and 110 degrees from vertical.

A wellhead 110 is coupled to and substantially encloses the wellbore 102 at the surface 104. The wellhead 110 includes conduits and valves to direct and control the flow of fluids to and from the wellbore 102.

In some embodiments, for example, a wellbore string 108 is employed within the wellbore 102 for stabilizing the subterranean formation 100. In some embodiments, for example, the wellbore string 108 also contributes to effecting fluidic isolation of one zone within the subterranean formation from another zone within the subterranean formation.

A cased-hole completion involves running wellbore casing down into the wellbore 102 through the production zone. In this respect, in the cased-hole completion, the wellbore string 108 includes wellbore casing.

The annular region between the deployed wellbore casing and the subterranean foramtion may be filled with cement for effecting zonal isolation (see below). The cement is disposed between the wellbore casing and the subterranean formation for the purpose of effecting isolation, or substantial isolation, of one or more zones of the subterranean formation 100 from fluids disposed in another zone of the subterranean formation. Such fluids include hydrocarbon material being produced from another zone of the subterranean formation (in some embodiments, for example, such hydrocarbon material being flowed through a production string disposed within and extending through the wellbore casing to the surface), or injected fluids such as water, gas (including carbon dioxide), or stimulations fluids such as fracturing fluid or acid. In this respect, in some embodiments, for example, the cement is provided for effecting sealing, or substantial sealing, of flow communication between one or more zones of the subterranean formation and one or more others zones of the subterranean formation (for example, such as a zone that is being produced). By effecting the sealing, or substantial sealing, of such flow communication, isolation, or substantial isolation, of one or more zones of the subterranean formation, from another subterranean zone (such as a producing formation), is achieved. Such isolation or substantial isolation is desirable, for example, for mitigating contamination of a water table within the subterranean formation by reservoir fluid (including. oil, gas, salt water, or combinations thereof) being produced, or the above-described injected fluids.

In some embodiments, for example, the cement is disposed as a sheath within an annular region between the wellbore casing and the subterranean formation. In some embodiments, for example, the cement is bonded to both of the casing and the subterranean formation.

In some embodiments, for example, the cement also provides one or more of the following functions: (a) strengthens and reinforces the structural integrity of the wellbore, (b) prevents, or substantially prevents, produced reservoir fluid of one zone from being diluted by water from other zones. (c) mitigates corrosion of the wellbore casing, (d) at least contributes to the support of the wellbore casing, and e) allows for segmentation for stimulation and fluid inflow control purposes.

The cement is introduced to an annular region between the wellbore casing and the oil reservoir after the subject wellbore casing has been run into the wellbore. This operation is known as "cementing".

In some embodiments, for example, the wellbore casing includes one or more casing strings, each of which is positioned within the well bore, having one end extending from the well head. In some embodiments, for example, each casing string is defined by jointed segments of pipe. The jointed segments of pipe typically have threaded connections.

Typically, a wellbore 102 contains multiple intervals of concentric casing strings, successively deployed within the previously run casing. With the exception of a liner string, casing strings typically run back up to the surface 104.

For wells that are used for producing hydrocarbon material, few of these actually produce through wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct produced hydrocarbon material, received within the wellbore 102, to the wellhead 110. In some embodiments, for example. the annular region between the last casing string and the production string may be sealed at the bottom by a packer.

To facilitate flow communication between the subterranean formation 100 and the wellbore 102, the wellbore casing may be perforated, or otherwise include per-existing ports (which may be selectively openable, such as, for example, by shifting a sleeve), to provide a fluid passage for enabling flow communication between the wellbore 102 and the subterranean formation 100.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead 110. Cement may be provided within the annular region between the liner string and the oil reservoir for effecting zonal isolation (see below), but is not in all cases. In some embodiments, for example, this liner is perforated to effect flow communication between the subterranean formation 100 and the wellbore 102. In this respect, in some embodiments, for example, the liner string can also be a screen or is slotted. In some embodiments, for example, the production tubing string may be engaged or stung into the liner string, thereby providing a fluid passage for conducting the produced hydrocarbon material to the wellhead 110. In some embodiments, for example, no cemented liner is installed, and this is called an open hole completion or uncemented casing completion.

An open-hole completion is effected by drilling down to the top of the producing formation, and then casing the wellbore (with a wellbore string 108). The wellbore is then drilled through the producing formation, and the bottom of the wellbore is left open (i.e. uncased), to effect flow communication between the reservoir and the wellbore. Open-hole completion techniques include bare foot completions, pre-drilled and pre-slotted liners, and open-hole sand control techniques such as stand-alone screens, open hole gravel packs and open hole expandable screens. Packers and casing can segment the open hole into separate intervals and ported subs can be used to effect flow communication between the reservoir and the wellbore.

Production of hydrocarbon material is stimulated from the subterranean formation 100 by effecting hydraulic fracturing of the subterranean formation 100 to form one or more induced fractures 112 within the subterranean formation. In this respective, in some embodiments, for example, the hydraulic fracturing includes injecting a first conditioning material into the subterranean formation 100 from a source 106 at a pressure above the fracture initiation pressure. The first conditioning material is injected at a sufficient rate such the injection rate exceeds the filtration rate into the subterranean formation 100, thereby producing increasing fluid pressure at the face of the formation. When the pressure exceeds the tensile strength of the formation 100 and overcomes the in-situ least principal stress, the formation cracks and fractures. This threshold pressure is known as the fracture initiation pressure and is characteristic of the subterranean formation into which the treatment material is injected.

In some embodiments, for example, the first conditioning material is a formation conditioning material, and the formation conditioning material includes a liquid, such as a liquid including water. In some embodiments, for example the formation conditioning material includes chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol.

In some embodiments, for example, the formation conditioning material is a slurry including water and solid particulate matter, such as proppant. When the formation conditioning material includes proppant, the injecting is with effect that the proppant is deposited within the induced one or more fractures to prevent, or at least mitigate, the closing of the one or more fractures once the injecting of the treatment material is suspended, thereby helping to preserve the integrity of the flow path, provided by the fractures, to the wellbore 102.

The subterranean formation 100 includes naturally-occurring fractures. The fracturing of the formation is with effect that the one or more induced fractures becomes disposed in flow communication with naturally-occurring fractures within the hydraulically fractured formation, such that communicating naturally-occurring fractures, disposed in a preconditioned state, are obtained.

In some embodiments, for example, after the hydraulic fracturing, the injecting of the first conditioning material is suspended, and with a primary view to increasing the permeability of naturally-occurring fractures 114 within the subterranean formation 100, that are disposed in flow communication with the induced fractures 112, a post-fracturing conditioning material is injected, from a source 106, into the formation via the wellbore for effecting such increase in permeability and obtaining conditioned naturally-occurring fractures. The post-fracturing conditioning material is injected at a pressure below that of the fracture initiation pressure of the subterranean formation 100. By injecting at a pressure below that of the fraction initiation pressure of the subterranean formation 100, the post-fracturing conditioning material is employed to increase the permeability of the naturally-occurring fractures 114, as opposed to creating new fractures or extending existing fractures. In some embodiments, for example, the post-fracturing conditioning material is the formation conditioning material, as above-described. In some embodiments, for example, the post-fracturing conditioning material includes proppant, and in some embodiments, for example, the proppant includes drill cuttings, such as those obtained from drilling of the wellbore 102.

In some embodiments, for example, after the hydraulic fracturing, and prior to the injecting of the post-fracturing conditioning material, flowback of at least a portion of the injected first conditioning material is effected.

In some embodiments, for example, after the hydraulic fracturing, and prior to the injecting of the post-fracturing conditioning material, producing of hydrocarbon material is effected from the subterranean formation 100, via the one or more induced fractures, through the wellbore 102, and to the surface 104. In such embodiments, after the producing of the hydrocarbon material is suspended, the post-fracturing conditioning material is injected into the subterranean formation 100.

In some embodiments, for example, the post-fracturing conditioning material is injected at a pressure of less than 90% of the pressure at which the first conditioning material is injected (for effecting the formation of the induced fractures), such as, for example, at a pressure that is less than 80% of the pressure at which the first conditioning material is injected, such as, for example, at a pressure that is less than 70% of the pressure at which the first conditioning material is injected; such as, for example, at a pressure that is less than 60% of the pressure at which the first conditioning material is injected, such as, for example, at a pressure that is less than 50% of the pressure at which the first conditioning material is injected.

In some embodiments, for example, the injecting of the post-fracturing conditioning material effects an increase in permeability of one or more of the naturally-occurring fracture 114 such that the permeability of the conditioned naturally-occurring fracture is greater than the permeability of the pre-conditioned naturally-occurring fracture by a multiple of at least ten (10), such as, for example, by a multiple of at least 50, such as, for example, by a multiple of at least 100, such as, for example, by a multiple of at least 500, such as, for example, by a multiple of at least 1000.

In some embodiments, for example, the injecting of the post-fracturing conditioning material effects an increase in cross-sectional area of one or more of the naturally-occurring fracture 114. In this respect, the pre-conditioned naturally-occurring fracture has a pre-conditioning cross-sectional area at an axial position along the longitudinal axis of the naturally-occurring fracture, and the conditioned naturally-occurring fracture has a post-conditioning cross-sectional area at the axial position, and the post-conditioning cross-sectional area is greater than the pre-conditioning cross-sectional area by a multiple of at least ten (10), such as, for example, by a multiple of at least 50, such as, for example, by a multiple of at least 100, such as, for example, by a multiple of at least 500, such as, for example, by a multiple of at least 1000.

In some embodiments, for example, the injecting of the post-fracturing conditioning material effects an increase in surface area of the naturally-occurring fractures 114. In this respect, the pre-conditioned naturally-occurring fractures have a pre-conditioning surface area, and the conditioned naturally-occurring fracture have a post-conditioning surface area, and the post-conditioning surface area is greater than the pre-conditioning surface area by at least 100%, such as, for example, at least 1000%, such as, for example, at least 10,000%, such as, for example, by at least 100,000%

In some embodiments, for example, the total volume of post-fracturing conditioning material that is injected is at least 42,000,000 U.S. Gallons, such as, for example, 420,000,000 U.S. Gallons.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A process for producing hydrocarbon material from a subterranean formation comprising:

injecting a first conditioning material at a first pressure which is at or above a fracture initiation pressure, via a wellbore, to effect fracturing of a subterranean formation such that a hydraulically fractured formation, including an induced fracture disposed in flow communication with naturally-occurring fractures of the subterranean formation such that flow-communicating, pre-conditioned naturally-occurring fractures, are obtained;

after the fracturing, injecting post-fracturing conditioning material at a second pressure, via the wellbore, into the hydraulically fractured formation, wherein the injecting of the post-fracturing conditioning material is controlled within a range below the fracture initiation pressure to increase cross-sectional areas of the pre-conditioned naturally-occurring fractures such that conditioned naturally-occurring fractures are obtained; and after the injecting of the post-fracturing conditioning material, producing, via the wellbore, hydrocarbon material from the hydraulically fractured formation;

wherein:

the second pressure of the post-fracturing conditioning material is less than the first pressure of the first conditioning material and the fracturing initiation pressure; and the post-fracturing conditioning material includes proppant and drill cuttings.

2. The process as claimed in claim 1;

wherein:

the pre-conditioned naturally-occurring fractures have pre-conditioning cross-sectional areas at an axial position along the longitudinal axis of the naturally-occurring fractures;

the conditioned naturally-occurring fractures have post-conditioning cross-sectional areas at the axial position; and the post-conditioning cross-sectional areas are greater than the pre-conditioning cross-sectional areas by a multiple of at least ten (10).

3. The process as claimed in claim 1;

wherein, after the fracturing, and prior to the injecting of the post-fracturing conditioning material, hydrocarbon material is produced from the fractured formation via the wellbore.

4. The process as claimed in claim 1;

wherein, the total volume of post-fracturing conditioning material that is injected is at least 4,200,000 U.S. Gallons.

5. The process as claimed in claim 1;

wherein the pre-conditioned naturally-occurring fractures have a pre-conditioning surface area, and the conditioned naturally-occurring fractures have a post-conditioning surface area, and the post-conditioning surface area is greater than the pre-conditioning surface area by at least 100%.

6. The process as claimed in claim 1, wherein injecting the post-fracturing conditioning material comprises increasing the pressure from the second pressure to a third pressure, the third pressure lower than the fracture initiation pressure, and decreasing the pressure from the third pressure to a fourth pressure, the fourth pressure lower than the third pressure.

* * * * *